US007845379B2

(12) United States Patent
Körtge et al.

(10) Patent No.: US 7,845,379 B2
(45) Date of Patent: Dec. 7, 2010

(54) LABELING MACHINE FOR LABELING CONTAINERS, SUCH AS BOTTLES OR CANS, ESPECIALLY SARDINE CANS

(75) Inventors: Lutz Körtge, Hamburg (DE); Hans-Joachim Köther, Buchholz (DE)

(73) Assignee: KHS Maschinen-und Anlagenbau AG, Dortmund (DE)

( * ) Notice: Subject to any disclaimer, the term of this patent is extended or adjusted under 35 U.S.C. 154(b) by 1240 days.

(21) Appl. No.: 11/435,379

(22) Filed: May 16, 2006

(65) Prior Publication Data

US 2006/0272765 A1 Dec. 7, 2006

(30) Foreign Application Priority Data

May 20, 2005 (DE) ..... 10 2005 023 983

(51) Int. Cl.
*B65C 9/26* (2006.01)

(52) U.S. Cl. ..... 156/476; 156/486; 156/557; 156/567

(58) Field of Classification Search ..... 156/DIG. 12, 156/DIG. 13, 476, 486, 487, 564, 567, 570
See application file for complete search history.

(56) References Cited

U.S. PATENT DOCUMENTS 3,859,155 A * 1/1975 Dullinger ..... 156/212
5,858,143 A * 1/1999 Bright et al. ..... 156/86

FOREIGN PATENT DOCUMENTS

| | | |
|---|---|---|
| DE | AS 1 102 640 | 3/1961 |
| DE | GM 1 941 274 | 2/1970 |
| DE | OS 84 15 528 | 8/1984 |
| DE | 87 03 630 U1 | 4/1987 |
| DE | 41 19 407 A1 | 12/1992 |
| DE | 696 32 211 | 8/2001 |
| EP | 0 974 524 A | 1/2000 |
| EP | 10 52 176 | 11/2000 |

OTHER PUBLICATIONS

European Patent Office Search Report EP 1 724 196 A1 and English translation thereof.

* cited by examiner

*Primary Examiner*—Richard Crispinl
*Assistant Examiner*—Barbara J. Musser
(74) *Attorney, Agent, or Firm*—Nils H. Ljungman & Associates

(57) ABSTRACT

Labeling machine and method for labeling containers, such as bottles or cans, especially sardine cans. The abstract of the disclosure is submitted herewith as required by 37 C.F.R. §1.72(b). As stated in 37 C.F.R. §1.72(b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made relating to the abstract are not intended to limit the claims in any manner and should not be interpreted as limiting the claims in any manner.

20 Claims, 3 Drawing Sheets

LABELING MACHINE FOR LABELING CONTAINERS, SUCH AS BOTTLES OR CANS, ESPECIALLY SARDINE CANS

BACKGROUND

1. Technical Field

This application relates to a labeling machine and method for labeling containers, such as bottles or cans, especially sardine cans. Such cans are usually longer than they are high or wide, and thus utilize labels that are longer than they are wide, i.e. have a ribbon-like shape. Since such labels are relatively much longer than they are wide, it is advantageous to guide and align the labels throughout the process of affixing the labels to the cans in order to promote optimum alignment and centering on the exterior surface of the cans.

This application further relates to a labeling machine for containers such as cans, bottles and similar containers, comprising transport means for the containers, a rotating carrier with a plurality of turntables that are supported on them so that they can be driven in rotation and/or oscillation, for the supportive and centering holding of the containers with docking stations that are located in a stationary manner on the peripheral edge of the rotating carrier, and specifically at least one gluing station, a label storage station with a label magazine and a label transfer station with transfer elements, whereby the gluing station is formed of a rotating glue roller, a glue application mechanism and/or a glue spray station that can be turned on and off.

2. Background Information

Labeling machines of this type are known in a variety of models, in particular in the form of rotary or linear machines. DE-OS 84 15 528 discloses a labeling machine with a gluing and application device that holds and guides the labels, upstream of which is a magazine of individual labels with a label extractor that is located on its front side. This individual label magazine is realized in the form of a pneumatic device that uses a vacuum and can be pivoted around a vertical axis. The label extractor also has a crank drive, with which, in addition to the pivoting movement, a transfer movement for the extracted labels to a gluing device can be executed parallel to the front side of the label magazine. The further transport of the labels takes place by means of conveyor belts. DE-AS 1 102 640 and DE-GM 1 941 274 disclose gripper cylinders for the transfer of the labels to circulating glue pallets, in which the extraction and holding of the labels is accomplished either by suction nozzles in connection with mechanically acting gripper fingers or by suction nozzles alone. The labels are thereby transferred to a container by the rolling motion of the glue pallet along the rotating cylindrical surface of the container.

These systems of the prior art are preferably used to transfer standard mass-produced labels that have approximately equal height and width ratios into the labeling area. If, on the other hand, the process calls for labels in strip form that have a large ratio between the height of the label and the length of the label, these systems of the prior art cannot be used successfully.

In one method of the prior art for the handling of bands or strips in connection with their application to packages, the bands or strips are extracted individually and one after another from the stack of bands or strips, and are transported along a track that is in the shape of a circular arc and then guided along a straight-line track until they are transferred to a package that is being transported at a right angle to said track. The device required to perform this action is equipped with a band pick-up device which has a plurality of banderole carriers rotating in circulation, by means of which the bands or strips are transferred to a straight-line endless conveyor with suction strips. From there, the bands or strips are conducted to a transfer station, where they are kept ready and transferred to packages that are being transported in a transverse direction. The suction strips used are thereby used only for the transport of the bands or strips that are being processed. Suction strips of this type are not suited for labeling using labels that have a very ratio of height to width. Labels of this type have only an extremely low inherent stability and consequently cannot be processed and applied with the required level of quality using the systems described in the prior art.

OBJECT OR OBJECTS

Taking into consideration the disadvantages of the systems of the prior art described above, the object of one possible embodiment of the invention is to overcome said disadvantages and to create a device with which strip-shaped labels of the type described above, for example, can be processed easily. In particular, for the labeling of containers that are not rotationally symmetrical, at least one possible embodiment teaches a technically supported forced guidance in the zones in which otherwise it is impossible to prevent the breakout of unstable labels or strip labels.

SUMMARY

At least one possible embodiment teaches that this object can be accomplished by a labeling device of the type described herein, whereby a first stationary and vacuum-assisted guide device that is associated with the end surface of the label magazine is provided, and at least one second vacuum-assisted guide device that is associated with each turntable and rotates with said turntables around the longitudinal axis of the machine for the controlled forced guidance of the labels to be applied.

At least one possible embodiment teaches that the label is extracted from the label magazine after a preceding initial gluing of the container, and by the container, whereby the label extracted in this manner is extracted from the label magazine along a first, stationary guide device in a sliding motion, and by the continued rotation of the container with the turntable and as a result of its simultaneous rotation around the longitudinal axis of the machine, and at least after the completed initial gluing is taken over and steered by a second guide device and guided in a sliding movement over its remaining length.

With the solution claimed by at least one possible embodiment, a preferably vacuum-assisted controlled forced guidance of the label is provided for the label from its extraction from the label magazine until its application and final labeling. This arrangement has the advantage, among other things, that at the end of the application process, the otherwise conventional overlap tolerances are significantly smaller.

Additional features of at least one possible embodiment of the invention are described in greater detail below on the basis of preferred examples. The features that are described and/or illustrated are the object of at least one possible embodiment, both individually and/or in any possible combination.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

At least one possible embodiment is explained in greater detail below on the basis of the exemplary embodiment illustrated in the accompanying drawings, in which.

DESCRIPTION OF EMBODIMENT OR EMBODIMENTS

Figure 1A:
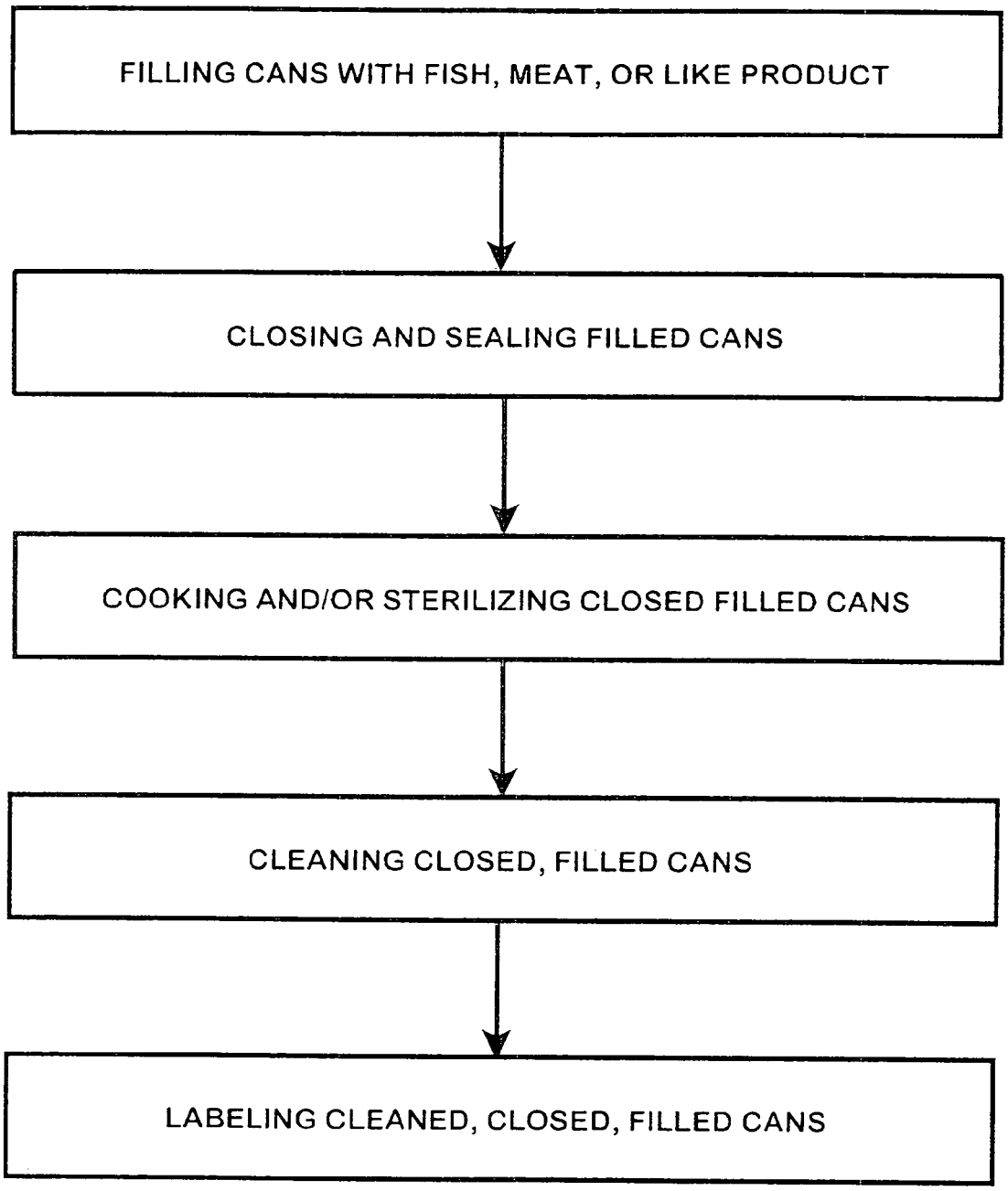
FIG. 1A shows steps in a canning and labeling process for the canning of fish, meat, or like product, according to at least one possible embodiment.

FIG. 1A shows steps in a canning and labeling process for the canning of fish, meat, or like product, according to at least one possible embodiment. In at least one possible embodiment, the product to be canned is fish, such as sardines or herring. Because of the size and shape of the fish, the cans used are usually longer than they are wide or tall, and usually have an elliptical or oval shape when viewed from above.

In a canning process, the product is of course first placed in the cans by any one of a number of methods, depending on the product to be canned. Next, the filled cans are closed and/or sealed shut. The closed cans are then heated to a desired temperature to cook and/or sterilize the contents to prevent contamination. If the cans are not finally sealed after the cooking step, a final sealing can be performed after the cooking, in at least one possible embodiment. The closed, filled cans are then cleaned to remove any contaminants or product residue off the exterior of the cans. The cleaned cans are then labeled by a labeling machine, such as described herein.

Figure 1:
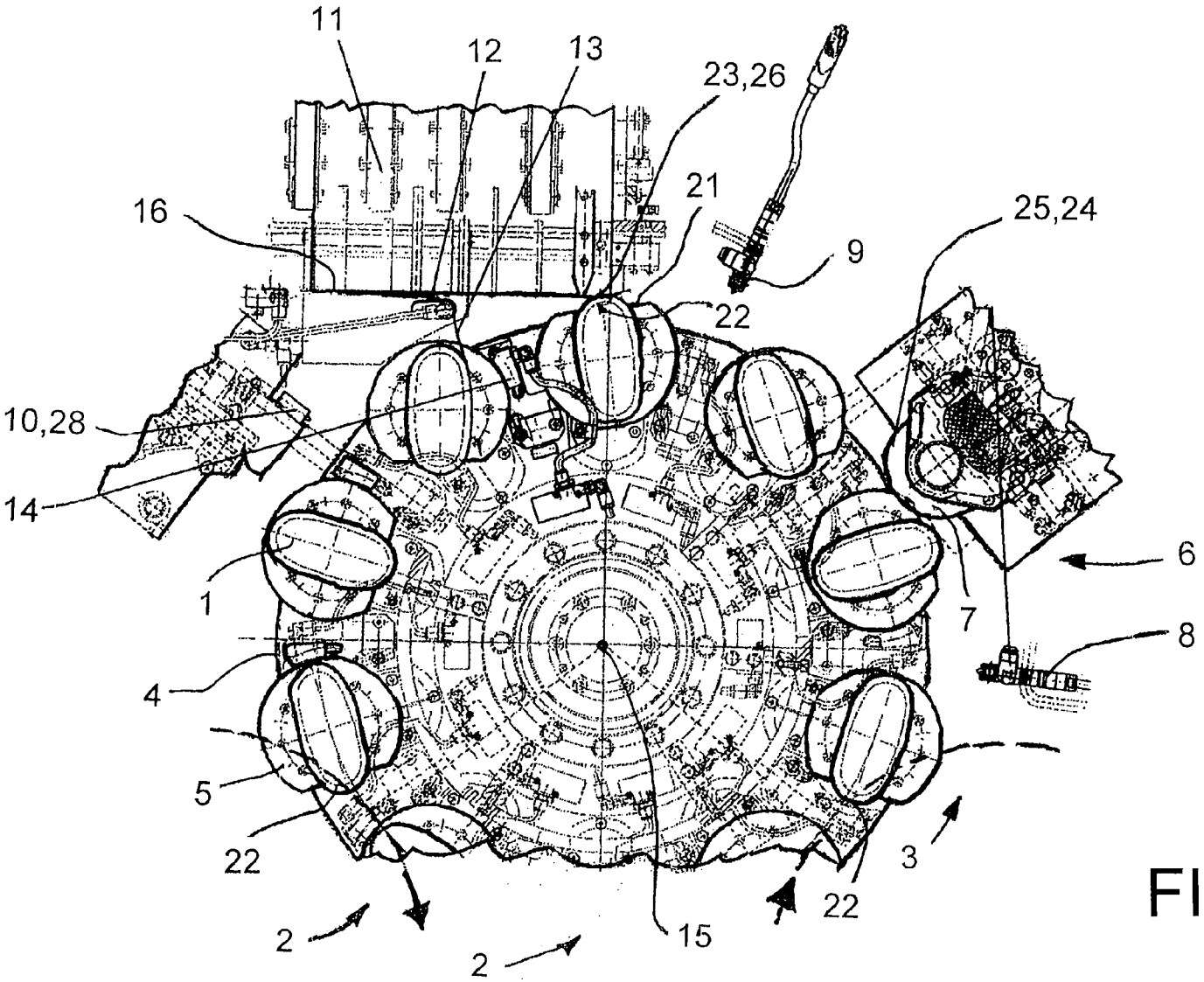
FIG. 1 illustrates a portion of a labeling device in cross section.

As shown in FIG. 1, the labeling machine comprises transport means for the containers 1, with an inlet and outlet area 2, only parts of which are shown, and a carrier 4 that rotates in the direction indicated by the arrow 3. Located on this carrier 4, at uniform angular intervals, are a plurality of turntables 5 that can be driven in rotation and/or oscillation for the supportive and centering holding of the containers 1.

These turntables are driven by means of rotation gear trains that are located underneath the carrier 4, as described by EP 1 052 176 A1, for example, and the content of which, to the extent that it contributes to the explanation of at least one possible embodiment, is hereby incorporated by reference into this description. On the peripheral edge of the rotating carrier 4 there are docking or screw-on stations such as the gluing station 6 with a glue roller 7, spray or injection gluing mechanisms 8, 9, 10 and a labeling station with a label magazine 11. In connection with the label magazine 11 there is a first guide device 12 which is located on an end surface. This guide device is stationary and is held in the area of the label magazine so that it can be adjusted relatively multi-dimensionally with reference to the length to be processed and the required guidance and sliding motion of such a label 13. Effectively connected with said guide device 12 is a second, vacuum-assisted guide device 14 which is associated laterally with each turntable 5 and circulates with the latter around a longitudinal axis 15 of the machine. This second guide device is for the forced guidance of a label 13 to be applied during almost the entire labeling process, and in particular after the end 16 of each label 13 has traversed and exited the area of the first guide device 12, as will be explained in greater detail below.

This second guide device is held on the carrier 4 so that it can be adjusted vertically around an axis 17. In particular in the inlet and outlet area 2, in which the guide curves (which are not shown in any further detail) are provided to guide the entry and exit of the containers 1, the second guide device 14 can be moved outside its actual working height, preferably upward, so that it can be lowered again after it traverses this area. For this purpose, in the exemplary embodiment, a control curve 18 with a cam roller 19 is provided. Depending on the type of the initial gluing 8, the guide device can also be moved accordingly in this area to prevent contamination and similar phenomena. In addition, the guide device 14, like the guide device 12 in the appropriate configuration, has top and bottom guides 20 to fix the height of the label as it slides along.

Figure 2:
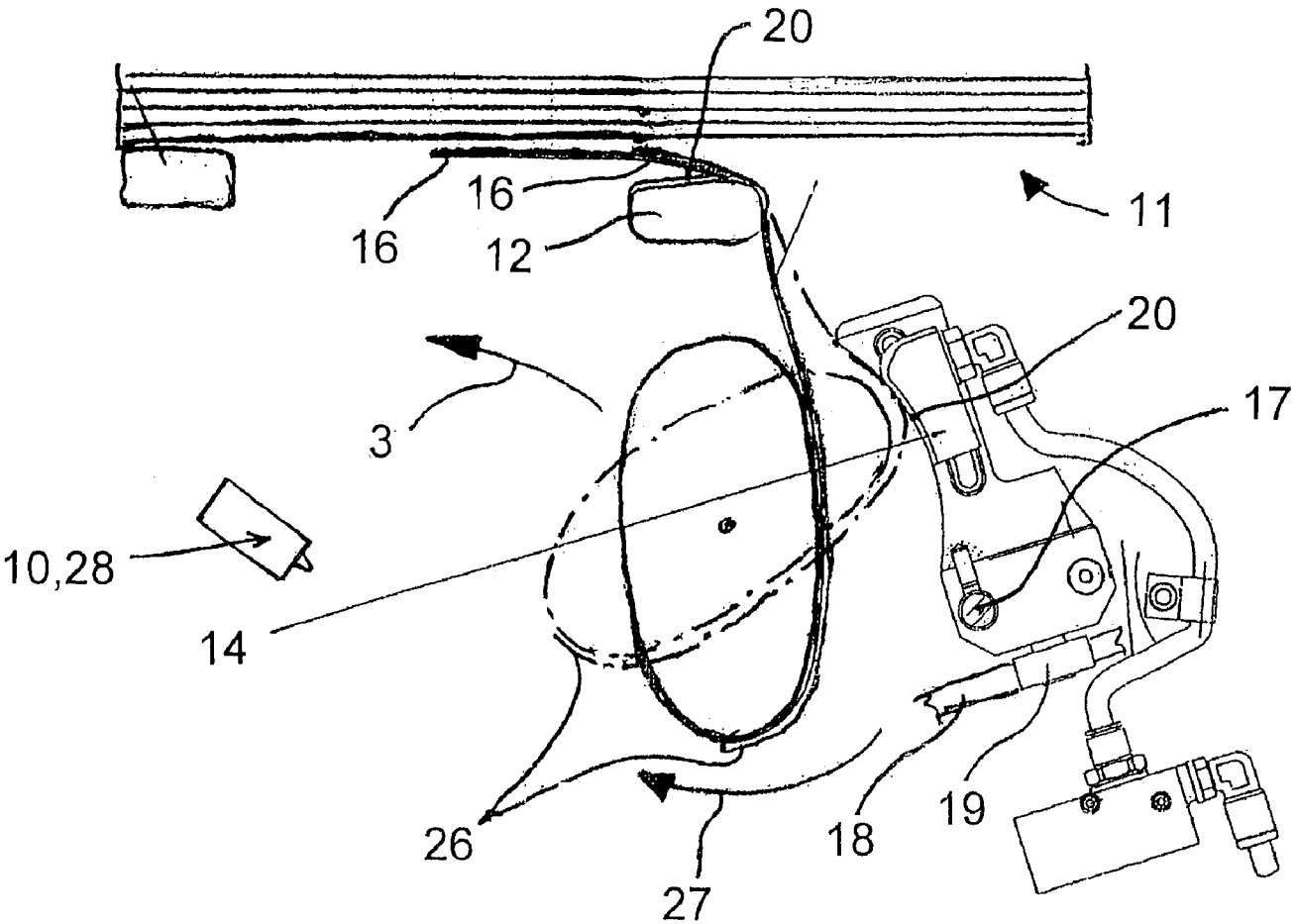
FIG. 2 is an enlarged detail of the path of the label on a container that is not rotationally symmetrical, for example a can for canned fish.

As also shown in FIG. 1, the turntables 5 have a flattened portion 21 on the end surface, above which areas 22 which are not rotationally symmetrical 22, like those that exist on the fish can to be labeled, project unsupported and can be moved closer to the beginning 23 of the label for the extraction of the label. For the actual transfer of the label and an initial gluing in this regard, the area 22 of a container 1 or of a fish can is first coated with glue using a system 24 in the form of a spray and/or roller gluing mechanism 25, and the area 22 thereby treated as a result of the superimposed torsion and rotation movements of the turntable 5 and of the carrier 4 are moved closer to the label magazine 11 under slight pressure and the initial area 26 of the strip-shaped label 13 is transferred. As the turntable 5 continues to rotate in the direction indicated by the arrow 27 and the carrier 4 continues to rotate in the direction indicated by the arrow 3, the label 13 is pulled farther along the preferably vacuum-assisted first guide device 12 out of the label magazine 11 and then, as shown in FIG. 2 and shown in broken lines, arrives in the vicinity of the second guide device 14 and is then also centered vertically by the guide device and transferred in a sliding movement. As the rotation continues, the end 16 of a label travels farther from the area of the label magazine and then also out of the range of the first guide device 12. The remaining area of this label part 16 is then kept under control as a result of the forced guidance performed by the second guide device 14, so that exposed areas of the label that are likely to flap all over the place are subjected to a stable forced guidance. In the vicinity of the overlapping zone, shortly before the ejection of the ejection process, the final overlapping gluing is done by means of a spray gluing mechanism 28. Depending on the realization of the containers 1 to be processed and their external contour, guidance is provided at an approximately equal distance at least by the second guide device and/or additional guide devices 14. Flexible guide devices 14 or other types of guide devices can also be used which are adapted to the contour of the respective container and/or move so that they follow this contour. Finally, in the context of at least one possible embodiment it is also conceivable to locate a plurality of stationary guide devices 12, 14 and guide devices 12, 14 that rotate with the turntables and are at least partly vacuum-assisted, in different numbers in relation to one another.

According to one possible embodiment, the labeling machine shown in FIG. 1 is suitable for use in labeling cans, such as cans for storing fish or meats. Such cans often have a circumference that is much greater than the height of the can. Consequently, the labels used to label such cans are much longer than they are wide, i.e. have the shape of a ribbon. These types of labels are prone to flop or move around during application to the cans, so it is advantageous to guide the labels as much as possible throughout the application process.

The labeling machine shown in FIG. 1, in at least one possible embodiment, promotes the accurate positioning and placement of the labels on the cans, such as cans for fish and meats. The cans 1, when viewed from above as in FIG. 1, have an elliptical shape. The circumference of the cans 1 is much greater than the height of the cans 1.

The labeling process, according to at least one possible embodiment, begins with the cans 1 being transferred by an input apparatus onto the turntables 5 of the carrier 4. The carrier 4 rotates, as seen in FIG. 1, counterclockwise, while the individual turntables 5 rotate in a clockwise direction. In this manner the cans 1 and turntables 5 are moved from station to the next, while the turntables 5 rotate to permit gluing and labeling of the cans 1.

Glue or other adhesive is first applied to a can 1 at the gluing station 6 by the roller 7 and/or the spray devices 8, 9. The can 1 is rotated by the turntable 5 to permit application of glue to a substantial portion of the outer side surface of the can 1. The turntable 5 rotates the can 1 into a position such that the area 22 of the can 1 that projects beyond the flat edge or surface 21 of the turntable 5 comes into contact with the beginning or end portion 23 of a label 13. By the adhesion of the glue and the pulling forces exerted by the clockwise rotation of the turntable 5 and by the counterclockwise movement of the carrier 4, which moves the turntable 5 away from the label magazine 11, the label 13 is extracted and applied to the can 1.

To minimize or substantially prevent misalignment of the label 13 on the can 1, two vacuum-assisted guide devices 12 and 14 are utilized to guide and align the label 13. The first guide device 12 guides the labels 13 as they leave the magazine 11. The second guide device 14, as can be seen in FIG. 2, assists the first guide device in guiding and aligning the label 13 onto the can 1. As the can 1 is rotated and the turntable 5 is moved away from the label magazine 11 by the movement of the carrier 4, the label 13 is disengaged from the first guide device 12. At this point, the second guide device 14 guides the remaining, unaffixed portion of the label 13. The second guide device 14 minimizes or prevents the unaffixed portion from flapping or moving around, which would otherwise happen without the second guide device 14.

After the majority of the label 13 has been applied to the can 1, the spray gluing mechanism 28 sprays an adhesive or glue onto the can 1 and label 13 at the point where the ends of the label 13 overlap to finally and securely affix the label 13 to the can 1.

One feature or aspect of an embodiment is believed at the time of the filing of this patent application to possibly reside broadly in a labeling machine for containers, cans, bottles etc., comprising transport means for the containers, a rotating carrier with a plurality of turntables mounted on it and driven so that they can rotate and/or oscillate, for the supportive and centering holding of the containers with docking stations that are located in a stationary manner on the peripheral edge of the rotating carrier, and specifically at least one gluing station, a label storage station with a label magazine and a label transfer station with transfer elements, whereby the gluing station is formed of a rotating glue roller, an glue application mechanism and/or a glue spray station that can be turned on and off, characterized in that a first stationary and vacuum-assisted guide device 12 associated with the end surface of the label magazine 11 is provided, and at least one second vacuum-assisted guide device 14 that is associated with each turntable 5 and rotates with the turntable around the longitudinal machine axis 15, for the controlled forced guidance of the labels 13 to be applied during the labeling process.

Another feature or aspect of an embodiment is believed at the time of the filing of this patent application to possibly reside broadly in the labeling machine, characterized in that the removal of a label 13 from the label magazine 11 takes place after a preceding initial gluing of the container 1 and by the container, and the label 13 that has been picked up in this manner is extracted from the label magazine 11 in a sliding movement along a first stationary guide device 12 and as the container 1 continues to rotate with the turntable 4 and simultaneously to rotate around the machine longitudinal axis 15, is picked up in a controlled manner at least after the completed initial gluing by a second guide device 14 and is guided in a sliding manner over its remaining length.

Yet another feature or aspect of an embodiment is believed at the time of the filing of this patent application to possibly reside broadly in the labeling machine, characterized in that a plurality of stationary and rotating and at least partly vacuum-assisted guide devices 12, 14 are also provided in different numbers in relation to each other.

Still another feature or aspect of an embodiment is believed at the time of the filing of this patent application to possibly reside broadly in the labeling machine, characterized in that at least one cylindrical area 22 of the container 1 is held unsupported for the initial gluing on a turntable 4 that rotates in a controlled manner.

A further feature or aspect of an embodiment is believed at the time of the filing of this patent application to possibly reside broadly in the labeling machine, characterized in that a cylindrical area 22 of the container 1 at least for the removal of a label 13 from the label magazine 13 projects beyond the peripheral edge of the turntable 4.

Another feature or aspect of an embodiment is believed at the time of the filing of this patent application to possibly reside broadly in the labeling machine, characterized in that the first stationary guide device 12 is held adjustably in its end-side position with reference to the length of a label 13 and in the necessary guide position.

Yet another feature or aspect of an embodiment is believed at the time of the filing of this patent application to possibly reside broadly in the labeling machine, characterized in that the second guide device 14 is mounted so that its height can be adjusted.

Yet another feature or aspect of an embodiment is believed at the time of the filing of this patent application to possibly reside broadly in the labeling machine, characterized in that the second guide device 14 can at least partly track the cylindrical surface of a container.

A further feature or aspect of an embodiment is believed at the time of the filing of this patent application to possibly reside broadly in the labeling machine, characterized in that the second guide device 14, at least in the inlet and outlet areas of the containers 1, can be moved out of its actual working position.

Another feature or aspect of an embodiment is believed at the time of the filing of this patent application to possibly reside broadly in the labeling machine, characterized in that the second guide device 14 can be moved outside the working position by means of a cam guide in the inlet and outlet area 2.

Yet another feature or aspect of an embodiment is believed at the time of the filing of this patent application to possibly reside broadly in the labeling machine, characterized in that an overlapping gluing is performed shortly before the process of closing the ends of the label.

Still another feature or aspect of an embodiment is believed at the time of the filing of this patent application to possibly reside broadly in the labeling machine, characterized in that the overlapping gluing is in the form of a spray gluing 10, 28.

A further feature or aspect of an embodiment is believed at the time of the filing of this patent application to possibly reside broadly in the labeling machine, characterized in that the initial gluing of the container for purposes of the label extraction is done in the form of a spray gluing 9.

Another feature or aspect of an embodiment is believed at the time of the filing of this patent application to possibly reside broadly in the labeling machine, characterized in that the initial gluing of the container is in the form of a spray and roller gluing 7, 8.

Yet another feature or aspect of an embodiment is believed at the time of the filing of this patent application to possibly reside broadly in the labeling machine, characterized in that when containers 1 are used that have a varying external contour, at least in the initial area of the labeling process, said contour is tracked at an at least approximately equal distance by the second or an additional guide device.

Still another feature or aspect of an embodiment is believed at the time of the filing of this patent application to possibly reside broadly in the labeling machine, characterized in that the guide devices 14 can be adapted to the contour of the individual container and/or can follow said contour dynamically.

A further feature or aspect of an embodiment is believed at the time of the filing of this patent application to possibly reside broadly in the labeling machine, characterized in that the guide devices 12, 14 have upper and lower guides 2 to adjust to the height of the label.

Another feature or aspect of an embodiment is believed at the time of the filing of this patent application to possibly reside broadly in a labeling machine for containers, such as cans, bottles, etc., consisting of transport means for the containers, a rotating carrier with a plurality of turntables mounted on it and driven so that they can rotate and/or oscillate, for the supportive and centering holding of the containers with docking stations that are located in a stationary manner on the peripheral edge of the rotating carrier, and specifically at least one gluing station, a label storage station with a label magazine and a label transfer station with transfer elements. The problem occurs during the labeling of containers that are not rotationally symmetrical with overlength strip labels, namely the correct handling of these labels, which are extremely unstable. For this purpose, the invention provides a first stationary and vacuum-assisted guide device associated with the end surface of the label magazine and at least one second vacuum-assisted guide device that is associated with each turntable and rotates with the turntable around the longitudinal machine axis, for the controlled forced guidance of the labels to be applied during the labeling process.

Yet another feature or aspect of an embodiment is believed at the time of the filing of this patent application to possibly reside broadly in a method of labeling cans, such as cans for holding fish, meat, or like product, said cans being longer than they are high or wide, using a labeling machine comprising: an input arrangement being configured to receive cans to be labeled into said labeling machine and an output arrangement being configured to discharge labeled cans out of said labeling machine; a rotating carrier being operatively connected to said input and output arrangements to permit transport of cans into and out of said rotating carrier; a plurality of turntables being mounted about the periphery of said rotating carrier; each said turntable being configured to be individually driven to permit at least one of: rotation and oscillation thereof; each said turntable being configured to support and center a can thereon; at least one gluing arrangement comprising at least one of: a rotating glue roller and a glue spray device; a label magazine being configured to hold a supply of labels; a first stationary and vacuum-assisted guide device being configured to guide labels during affixing to cans; said first guide device being disposed adjacent said label magazine; at least one second vacuum-assisted guide device being disposed on said carrier and adjacent each turntable; and said at least one second guide device being configured to further to guide labels during affixing to cans, said method comprising the steps of: transporting with said input arrangement a can to be labeled into said rotating carrier; supporting and centering the can on a corresponding turntable; rotating said rotating carrier to move the can to said at least one gluing arrangement; rotating said turntable and applying adhesive to the exterior surface of the can; continuing rotating said rotating carrier to move the can to said label magazine; rotating said turntable to permit a portion of the exterior surface of the can to contact a leading edge of a label to begin removal of the label from said label magazine; continuing rotating said rotating carrier and continuing rotating said turntables to remove the label from the label magazine and apply the label to the exterior surface of the can; guiding the label with said first guide device during removal from said label magazine and application to the can; additionally guiding the label with said second guide device during removal from said label magazine and application to the can to minimize misalignment of the label on the can; continuing rotating said rotating carrier to move the labeled can to said output arrangement; transporting with said output arrangement the labeled can out of said rotating carrier; and repeating the above steps for each additional can to be labeled.

Still another feature or aspect of an embodiment is believed at the time of the filing of this patent application to possibly reside broadly in a labeling machine for labeling cans, such as cans for holding fish, meat, or like product, said cans being substantially longer than they are high or wide, said labeling machine comprising: an input arrangement being configured to receive cans to be labeled into said labeling machine and an output arrangement being configured to discharge labeled cans out of said labeling machine; a rotating carrier being operatively connected to said input and output arrangements to permit transport of cans into and out of said rotating carrier; a plurality of turntables being mounted about the periphery of said rotating carrier; each said turntable being configured to be individually driven to permit at least one of: rotation and oscillation thereof; each said turntable being configured to support and center a can thereon; at least one gluing arrangement comprising at least one of: a rotating glue roller and a glue spray device; a label magazine being configured to hold a supply of labels; a first stationary and vacuum-assisted guide device being configured to guide labels during affixing to cans; said first guide device being disposed adjacent said label magazine; at least one second vacuum-assisted guide device being disposed on said carrier and adjacent each turntable; and said at least one second guide device being configured to further to guide labels during affixing to cans.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

The corresponding foreign application, namely, Federal Republic of Germany Patent Application No. 10 2005 023 983.8, filed on May 20, 2005, having inventors Lutz Kortge and Hans-Joachim Kother, and DE-05-10 2005 023 983.3 and DE-PS 10 2005 023 983.8, are hereby incorporated by reference as if set forth in their entirety herein for the purpose of correcting and explaining any possible misinterpretations of the English translation thereof. In addition, the published equivalents of the above corresponding foreign applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A labeling machine for labeling cans, such as cans for holding fish, meat, or like product, said cans being substantially longer than they are high or wide, said labeling machine comprising:

an input arrangement being configured to receive cans to be labeled into said labeling machine and an output arrangement being configured to discharge labeled cans out of said labeling machine;

a rotating carrier being operatively connected to said input and output arrangements to permit transport of cans into and out of said rotating carrier;

a plurality of turntables being mounted about the periphery of said rotating carrier;

each said turntable being configured to be individually driven to permit at least one of: rotation and oscillation thereof;

each said turntable being configured to support and center a can thereon;

at least one gluing arrangement comprising at least one of: a rotating glue roller and a glue spray device;

a label magazine being configured to hold a supply of labels;

a first stationary and vacuum-assisted guide device being configured to guide labels during affixing to cans;

said first guide device being disposed adjacent said label magazine;

at least one second vacuum-assisted guide device being disposed on said carrier and adjacent each turntable; and said at least one second guide device being configured to further to guide labels during affixing to cans.

2. The labeling machine according to claim 1, wherein:

said at least one gluing arrangement comprises a first gluing arrangement and a second gluing arrangement;

said first gluing arrangement is configured to apply an adhesive to at least a portion of an exterior surface of an unlabeled can on said rotating carrier;

each said turntable is configured to rotate upon said turntable being disposed adjacent said label magazine to engage an adhesive-covered portion of an unlabeled can with a leading edge of a label in said label magazine, and to continue to rotate to extract the label from said label magazine and substantially simultaneously wrap the label around an exterior surface of a can;

said first guide device is configured and disposed to initially guide a label upon a label being extracted from said label magazine; and said at least one second guide device is configured and disposed to guide the remaining length of a label being affixed to a can to minimize movement of the free end of the label and to position the label in a desired orientation on an exterior surface of a can.

3. The labeling machine according to claim 2, wherein each of said turntables comprises an upper surface configured to support a substantial portion of a can thereon and to permit an unsupported portion of a can thereon to project beyond the outer perimeter of said upper surface.

4. The labeling machine according to claim 3, wherein each of said turntables is configured to rotate to bring an unsupported portion of a can thereon into engagement with a leading edge of a label in said label magazine.

5. The labeling machine according to claim 4, wherein said first guide device is adjustable in position to permit guidance of labels of different lengths.

6. The labeling machine according to claim 5, wherein said at least one second guide device is mounted on a vertical guide to permit adjustment of the vertical position of said at least one second guide device with respect to said upper surface of said turntable.

7. The labeling machine according to claim 6, wherein:

said at least one second guide device comprises a guide face disposed to face an exterior surface of a can on said turntable and configured to guide a label in a sliding manner thereon;

said guide face has a curved contour configured to at least partly track a cylindrical portion of an exterior surface of a can.

8. The labeling machine according to claim 7, wherein:

said at least one second guide device is configured to be vertically moved between a first, working position in which said at least one second guide device is disposed to guide labels and a second, vertically higher, resting position; and said at least one second guide device is configured to be vertically moved to the second, vertically higher, resting position at least in the inlet and outlet areas of the cans.

9. The labeling machine according to claim 8, wherein:

said labeling machine comprises a cam guide arrangement; and said cam guide arrangement is configured and disposed to vertically move said at least one second guide device between the first, working position and the second, vertically higher, resting position.

10. The labeling machine according to claim 9, wherein said second gluing arrangement is configured and disposed to spray glue on a leading edge portion of a label partially affixed to a can and on an area of the can adjacent to the leading edge portion of the label prior to a trailing edge portion of the label being affixed onto the leading edge portion of the label in an overlapping manner.

11. The labeling machine according to claim 10, wherein said first gluing arrangement is configured and disposed to spray glue onto at least a portion of an exterior surface of an unlabeled can.

12. The labeling machine according to claim 11, wherein:

said at least one gluing arrangement comprises a third gluing arrangement;

said third gluing arrangement comprises a glue sprayer and a glue roller configured to apply glue to the entire exterior side surface of an unlabeled can sufficient to adhere a label to the can; and said third gluing arrangement is disposed upstream of said first gluing arrangement.

13. The labeling machine according to claim 12, wherein said first gluing arrangement is configured and disposed to spray glue only onto a portion of an exterior surface of an unlabeled can to be brought into engagement with a leading edge of a label in said label magazine.

14. The labeling machine according to claim 13, wherein:

when cans are used that have a varying external contour, at least in the initial area of the labeling process, the contour is tracked at an at least approximately equal distance by said at least one second guide device or an additional guide device;

said at least one second guide device is configured to be adapted to the contour of the individual can and/or can follow said contour dynamically; and said at least one second guide device comprises upper and lower guides to adjust to the height position of a label.

15. A labeling machine for containers, cans, and bottles, comprising transport means for the containers, a rotating carrier with a plurality of turntables mounted on it and driven so that they can rotate and/or oscillate, for the supportive and centering holding of the containers with docking stations that are located in a stationary manner on the peripheral edge of the rotating carrier, and specifically at least one gluing station, a label storage station with a label magazine and a label transfer station with transfer elements, whereby the gluing station is formed of a rotating glue roller, an glue application mechanism and/or a glue spray station that can be turned on and off, characterized in that a first stationary and vacuum-assisted guide device associated with the end surface of the label magazine is provided, and at least one second vacuum-assisted guide device that is associated with each turntable and rotates with the turntable around the longitudinal machine axis, for the controlled forced guidance of the labels to be applied during the labeling process.

16. The labeling machine according to claim 15, wherein the removal of a label from the label magazine takes place after a preceding initial gluing of the container and by the container, and the label that has been picked up in this manner is extracted from the label magazine in a sliding movement along a first stationary guide device and as the container continues to rotate with the turntable and simultaneously to rotate around the machine longitudinal axis, is picked up in a controlled manner at least after the completed initial gluing by a second guide device and is guided in a sliding manner over its remaining length.

17. The labeling machine according to claim 16, wherein:

said labeling machine comprises a plurality of said first stationary and vacuum-assisted guide devices, and a plurality of said second vacuum-assisted guide devices;

said plurality of said first stationary and vacuum-assisted guide devices and said plurality of said second vacuum-assisted guide devices are provided in different numbers in relation to each other; and at least one cylindrical area of the container is held unsupported for the initial gluing on a turntable that rotates in a controlled manner.

18. The labeling machine according to claim 17, wherein:

a cylindrical area of the container at least for the removal of a label from the label magazine projects beyond the peripheral edge of the turntable; and the first stationary guide device is held adjustably in its end-side position with reference to the length of a label and in the necessary guide position.

19. The labeling machine according to claim 18, wherein:

the second guide device is mounted so that its height can be adjusted;

the second guide device can at least partly track the cylindrical surface of a container;

the second guide device, at least in the inlet and outlet areas of the containers, can be moved out of its actual working position;

the second guide device can be moved outside the working position by means of a cam guide in the inlet and outlet area;

said labeling machine comprises a first spray gluing mechanism configured to perform an overlapping gluing shortly before the process of closing the ends of the label; and the overlapping gluing is in the form of a spray gluing.

20. The labeling machine according to claim 19, wherein:

said labeling machine comprises a second spray gluing mechanism, a third spray gluing mechanism, and a glue roller;

the gluing of a portion of the container for purposes of the label extraction is done in the form of a spray gluing from said second gluing mechanism;

the initial gluing of the entire exterior surface of the container is in the form of a spray gluing from said third gluing mechanism and roller gluing by said glue roller;

when containers are used that have a varying external contour, at least in the initial area of the labeling process, said contour is tracked at an at least approximately equal distance by the second or an additional guide device;

the guide devices can be adapted to the contour of the individual container and/or can follow said contour dynamically; and the guide devices have upper and lower guides to adjust to the height of the label.

* * * * *